US010119668B2

(12) United States Patent
Merdinger

(10) Patent No.: US 10,119,668 B2
(45) Date of Patent: Nov. 6, 2018

(54) ADJUSTABLE CANDELABRA APPARATUS

(71) Applicant: Hazorfim Ltd., Kfar Daniel (IL)

(72) Inventor: Yakov Merdinger, Tel Aviv (IL)

( * ) Notice: Subject to any disclaimer, the term of this patent is extended or adjusted under 35 U.S.C. 154(b) by 0 days.

(21) Appl. No.: 15/187,935

(22) Filed: Jun. 21, 2016

(65) Prior Publication Data

US 2016/0377244 A1 Dec. 29, 2016

Related U.S. Application Data

(60) Provisional application No. 62/183,764, filed on Jun. 24, 2015.

(51) Int. Cl.

| | |
|---|---|
| ***F21V 21/14*** | (2006.01) |
| ***F21S 13/12*** | (2006.01) |
| ***F21V 35/00*** | (2006.01) |

(52) U.S. Cl.

CPC ..... *F21S 13/12* (2013.01); *F21V 35/00* (2013.01)

(58) Field of Classification Search

CPC ..... F21S 13/12; F21V 35/00

See application file for complete search history.

(56) References Cited

U.S. PATENT DOCUMENTS

| | | | | | |
|---|---|---|---|---|---|
| 3,091,106 | A * | 5/1963 | Crouch | F21V 35/00 | 431/154 |
| 3,603,780 | A * | 9/1971 | Lu | A47G 33/06 | 362/123 |
| 3,959,645 | A * | 5/1976 | Patry | F21V 21/116 | 211/107 |
| 4,228,487 | A * | 10/1980 | Hesse | F21V 21/12 | 362/240 |
| 6,010,331 | A * | 1/2000 | Tingley | F21S 13/00 | 126/540 |

* cited by examiner

*Primary Examiner* — Evan Dzierzynski

(74) *Attorney, Agent, or Firm* — The Roy Gross Law Firm, LLC; Roy Gross

(57) ABSTRACT

An adjustable candelabra apparatus having a pole, plurality of removable junctions and arms extending from the plurality of removable junctions, and candlestick holders.

19 Claims, 9 Drawing Sheets

ADJUSTABLE CANDELABRA APPARATUS

FIELD OF THE INVENTION

The present invention relates to the field of candelabra apparatuses, in which many candles are lit in a single apparatus having candle cups.

BACKGROUND OF THE INVENTION

A candelabrum or candelabra, sometimes called a candle tree, is a candlestick holder with multiple arms. Although the electrification of indoor lighting has relegated candleholders to the status of backup light sources in most homes and other buildings, interior designers continue to model light fixtures and lighting accessories after candelabra and candlesticks. Accordingly, the term "candelabra" has entered common use as a collective term for small-based incandescent light bulbs used in chandeliers and other lighting fixtures made for decoration as well as lighting.

Many candelabras are formed of a main vertical pole and arms extending from that vertical pole, each arm ends with a candlestick holder. Such candelabras are limited in the number of candlestick holders, for example in the range of 5 to 10. When a family wishes to light many candles in a single candelabra, for example more than 15 candles, the single vertical pole is highly unlikely to carry this amount of candles, or is likely to consume a large area or volume in the candle arrangement. In addition, when the family wishes to add more candlestick holders to prior art candelabra apparatuses, arms that carry the holders are added as new "floors" for the candelabra apparatus, which requires a heavier main pole and basis for the candelabra to be able to carry the tall apparatus. High candelabra apparatuses, for example in the height of 50-120 cm, reduces stability of the apparatus, which makes it danger in terms of collapsing from a surface such as a table, or candles falling from the candlestick holders.

SUMMARY OF THE INVENTION

The present invention discloses an adjustable candelabra apparatus comprising a main pole and a plurality of removable junctions designed to be attached to the main pole. The main pole may be vertical, configured to stand on a surface, such as a table, a kitchen top or a floor. The removable junction comprises a ring shaped internal interface designed to be slid on the pole and one or more arms extending from the removable junction and ending with at least one candlestick holder. In such a case, a single candelabra apparatus may have 10 removable junctions slide upon, and 2 different arms extending from each removable junction, enabling 20 candles to stand on a candelabra of less than 50 cm high and less than 80 cm long. In some other cases, the candelabra apparatus may have 12 removable junctions of 2 arms and 3 removable junctions of 4 arms, which accumulate to 36 candlestick holders. The removable junctions can be replaceable, for example by sliding them towards an end of the main pole. Thus, a user of the adjustable candelabra apparatus can replace 2 junctions connected to 2 arms each, with 2 removable junctions connected to 4 arms each. The result of the replacement is 4 added candlestick holders while maintaining the adjustable candelabra apparatus at basically the same height and with a similar volume.

The removable junction may be any rigid or semi rigid element comprising an internal surface in a shape of a ring that fits the external surface of the main pole, or a portion of the external surface, and maintains the ability of the junction to slide along the pole. In some cases, the internal surface of the removable junction may be in a shape of an open ring. For example the ring may surround only 270 degrees of the main pole circumference. The removable junction may be polygonal, for example a hexagon or an octagon, even in case the main pole external shape is circular or elliptical, as long as the ring shaped interface of the removable junction can be secured and fasten to the main pole. Some removable junction may be different than other removable junctions, for example in color, shape, size, number of arms extending therefrom, direction or length of arms extending therefrom, and additional properties. In some cases, the internal interface of the removable junction may be at the same diameter in both sides. In some other cases, the internal interface of the junction may be in a shape of a cone which the diameter in one rim of the cone is longer than the diameter in second rim of the cone. In some cases, the removable junction may contain one or more screws designed to fasten the junction to the pole. In some other cases, the pole can be pulled through the ring shaped internal surface of the junction until the desirable place and then be rotated till it sits in the desirable position.

The main pole may be hollow or full, to enable additional elements to be connected to a hollow volume between the sidewalls of the pole. The diameter of the main pole may vary, for example be wider on one end and narrower in another end. The variable width of the main pole enables positioning the removable junction according to the size of the ring shaped internal interface. That is, inserting the removable junction in the narrow end until the width of the main pole matches the ring shaped internal interface size.

The main pole may be extendable, for example by two or more sections connected to each other. In some other cases, the main pole is assembled of two or more sections connected in series in a cylindrical shape, in which each section can slide into a hollow volume of the next section.

In some exemplary embodiment, the adjustable candelabra apparatus may comprise bolts or any protruding elements to which the arms can connect, without the removable junctions. For example, via a magnet, or any mechanism desired by a person skilled in the art, that can secure a rigid arm of a length of 5-40 cm.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

DETAILED DESCRIPTION OF THE INVENTION

Figure 1:
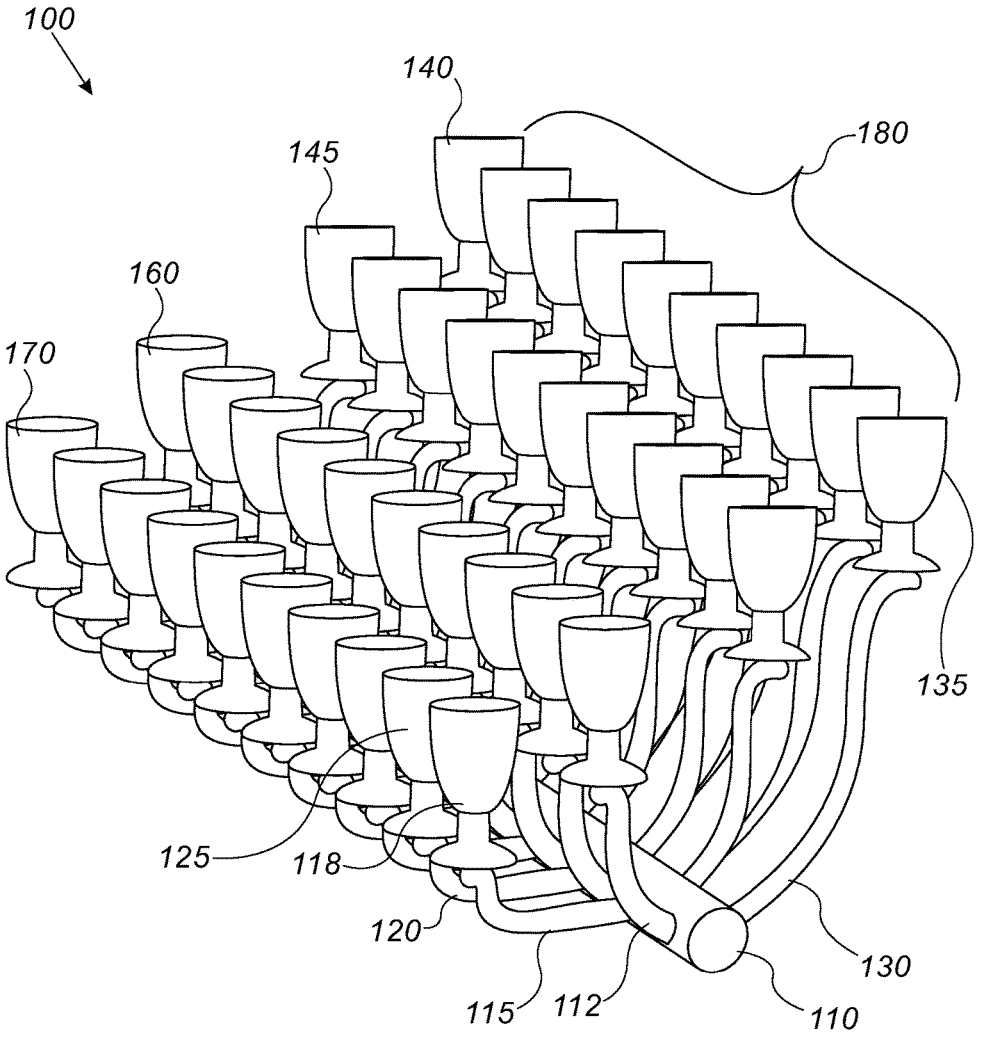
FIG. 1 shows an adjustable candelabra apparatus, according to exemplary embodiments of the disclosed subject matter.

FIG. 1 shows an adjustable candelabra apparatus, according to exemplary embodiments of the disclosed subject matter. The adjustable candelabra apparatus 100 comprises a main pole 110 and a plurality of arms extending from the removable junctions threaded on the main pole 110, at least some of the arms end with a candlestick holder. In the embodiment disclosed in FIG. 1, the adjustable candelabra apparatus 100 comprises a plurality of sets of arms, each set of arms ends with a plurality of candlestick holders, for example an upper set of candlestick holders 180, extending from a proximal candlestick holder 135 extending from arm 130 until distal candlestick holder 140. The adjustable candelabra apparatus 100 comprises 4 sets of arms, a first arm is a bottom arm having bottom candlestick holder, for example bottom arm 115 having bottom candlestick holder 118 and bottom arm 120 having bottom candlestick holder 125, until distal bottom candlestick holder 170. The second set comprises middle candlestick holder 160, the third set comprises candlestick holder 145. In some cases, each removable junction of adjustable candelabra apparatus 100 is connected to 4 arms, for example the removable junction is manufactured along with the arms, or the arms may be molded or welded into the removable junction.

Figure 2:
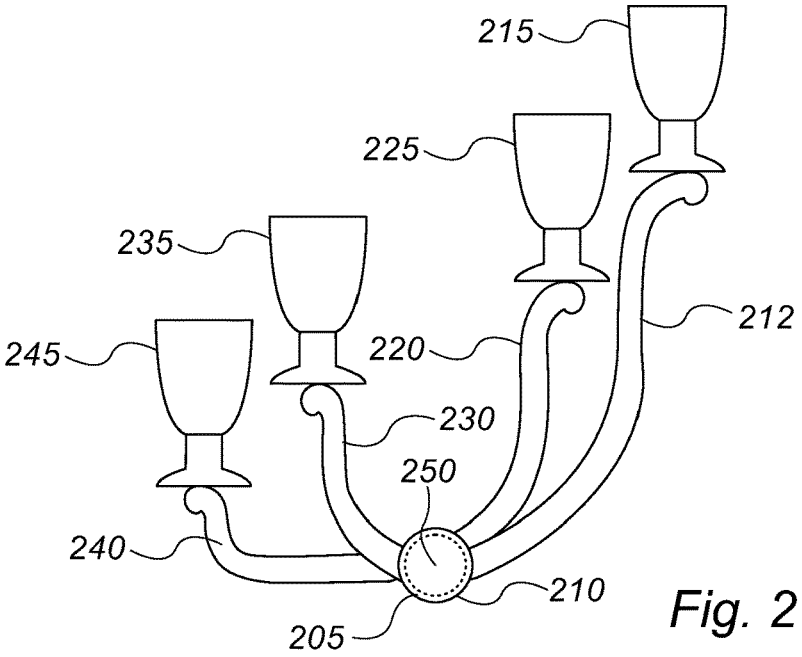
FIG. 2 shows a lateral cross-section of a removable junction comprising a ring shaped internal interface and associated arms of the adjustable candelabra apparatus, according to exemplary embodiments of the disclosed subject matter.

FIG. 2 shows a lateral cross-section of a removable junction comprising a ring shaped internal interface and associated arms of the adjustable candelabra apparatus, according to exemplary embodiments of the disclosed subject matter. The removable junction 210 comprising a ring shaped interface 205 surrounds the main pole 250 after being inserted in one end of the main pole 250. The ring shaped interface 205 is attached to arms 212 and 230 and the subsequent removable junction is connected to arms 220 and 240. Arm 212 ends with candlestick holder 215, arm 220 ends with candlestick holder 225, arm 230 ends with candlestick holder 235 and arm 240 ends with candlestick holder 245. In some exemplary embodiments of the disclosed subject matter, each of the 4 arms 212, 220, 230 and 240 has a different shape and extends to a different height from the surface on which the main pole 250 is mounted, for example a table or a shelf. For example, each of the 4 candlestick holders 215, 225, 235 and 245 has a different distance from removable junction 210 on which the main pole 250 is mounted.

Figure 3:
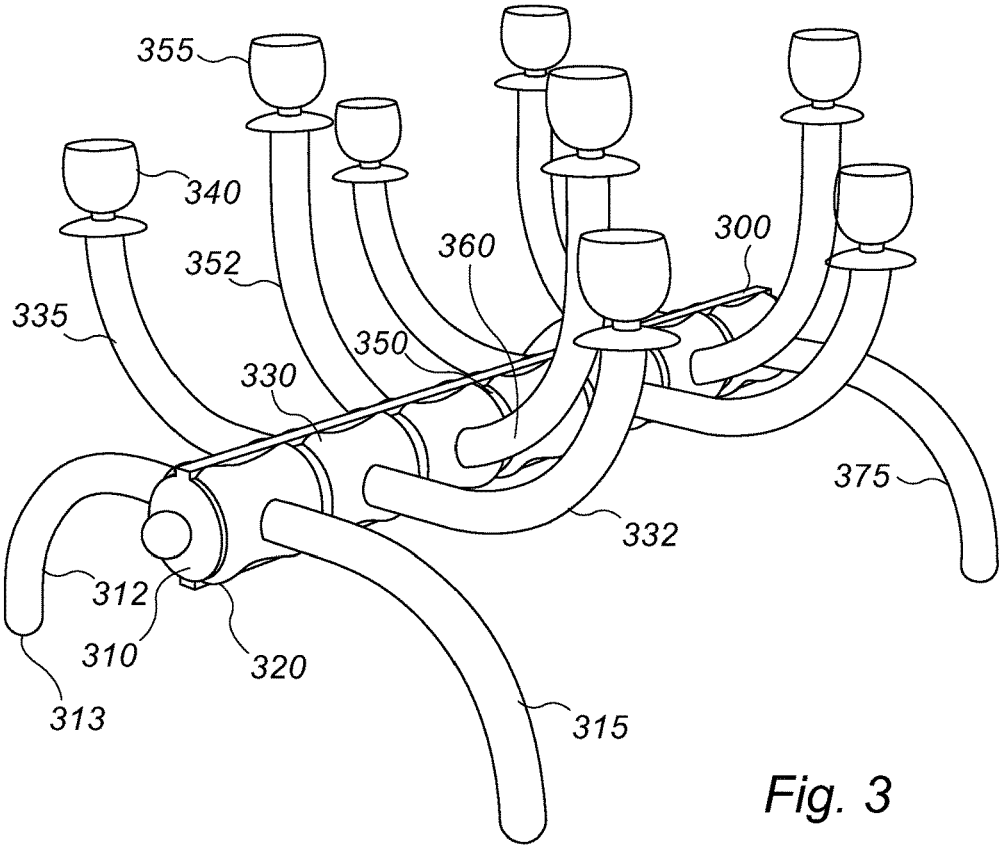
FIG. 3 shows an adjustable candelabra apparatus with multiple removable junctions connected thereto and legs, according to exemplary embodiments of the disclosed subject matter.

FIG. 3 shows an adjustable candelabra apparatus with multiple removable junctions connected thereto and legs, according to exemplary embodiments of the disclosed subject matter. The main pole 300 has a plurality of removable junctions slid over, for example removable junctions 320, 330, 350. The main pole 300 comprises a locking unit 310, that, when attached to one end of the main pole 300, prevents the removable junctions from sliding out of the main pole 300. The locking unit 310 may be connected to the main pole 300 by a screw mechanism. The locking unit 310 may be wider than the main pole 300, in a way that prevents the rings from moving laterally towards an end of the main pole 300.

Removable junction 320 is attached to two legs 312, 315 of the adjustable candelabra apparatus. Leg 312 is in contact with a surface, such as a table, via tip 313. The legs 312, 315 and 375 are in contact with the surface on which the adjustable candelabra apparatus is mounted. The adjustable candelabra apparatus may have one or more removable junction attached to legs that carry the adjustable candelabra apparatus. The legs may be in the middle of the main pole 300 or in the main pole 300 sides. The legs may be of different size, weight, material or shape. Removable junction 330 is attached to arms 332 and 335, such that arm 335 ends with candlestick holder 340. Arms 352 and 360 extend from removable junction 350, and candlestick holder 355 is located at an end of arm 352. In some exemplary embodiments of the disclosed subject matter the arms may be attached to the removable junction by a screw mechanism, molding or any other technique desired by a person skilled in the art. For example, arm 332 may be screwed to removable junction 330. In some cases, the arms 332 can be decoupled from the removable junction 330 by screwing it out and then be replaced with another arm.

Figure 4A:
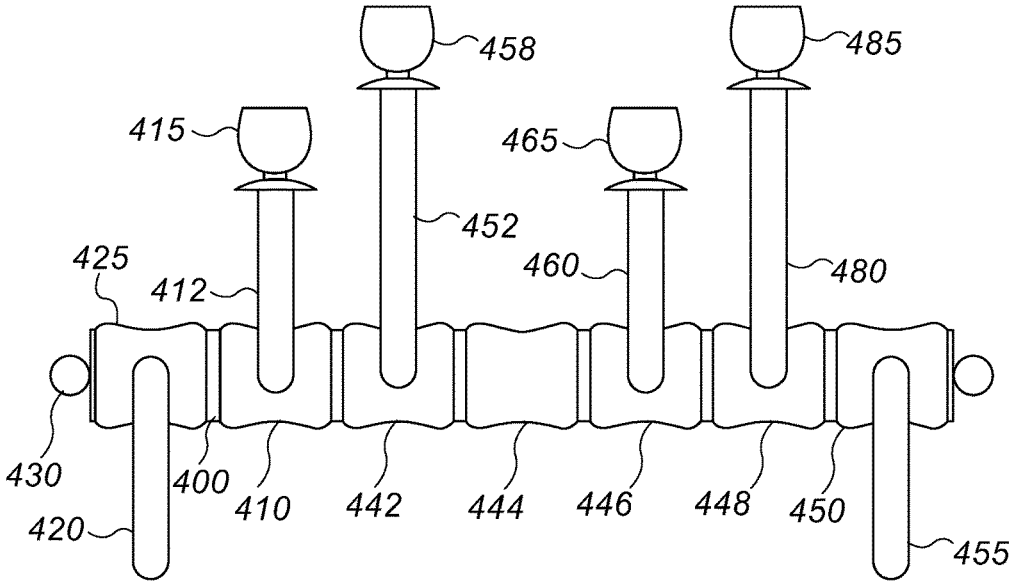
FIGS. 4A-4C show various angles of an adjustable candelabra apparatus with multiple removable junctions connected thereto and legs, according to exemplary embodiments of the disclosed subject matter.
Figure 4B:
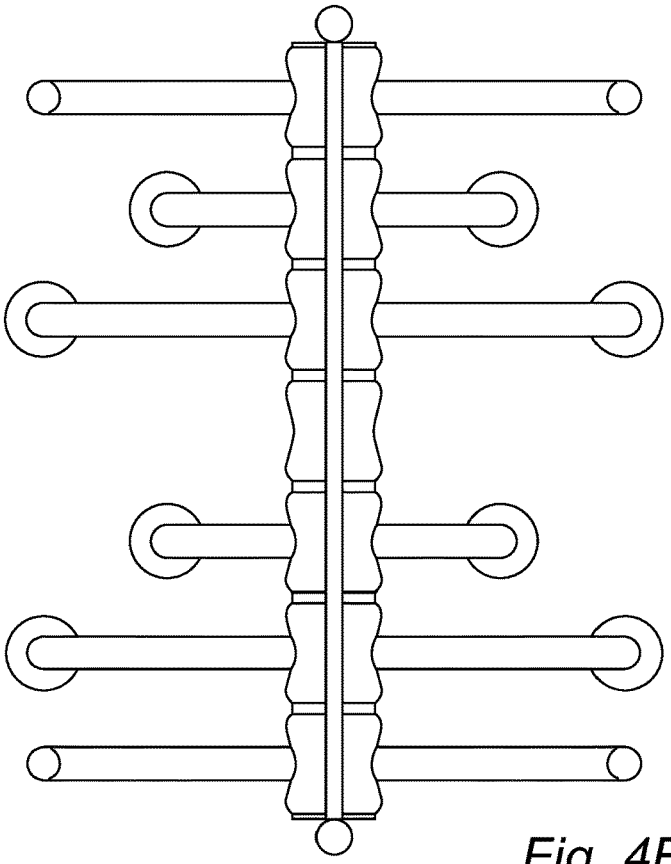
Figure 4C:
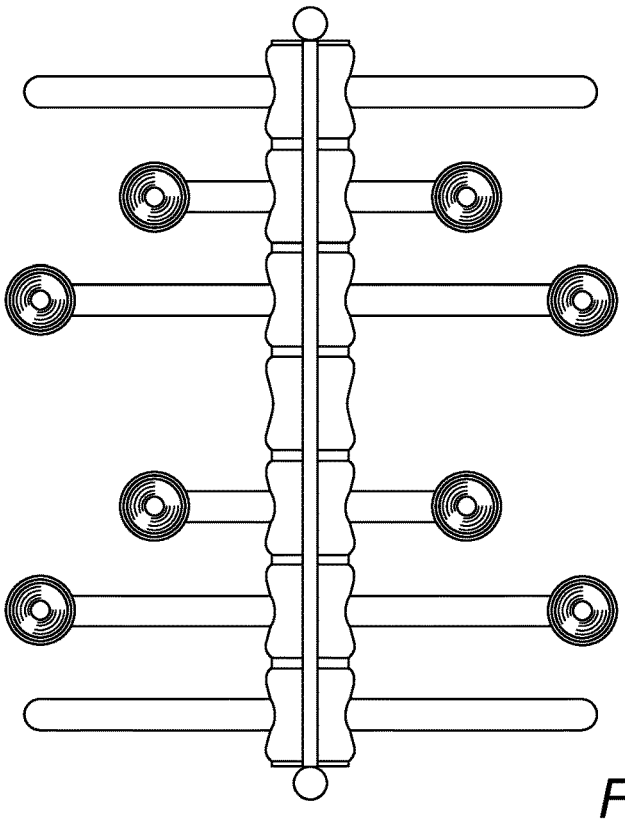

FIG. 4A-4C show various angles of an adjustable candelabra apparatus with multiple removable junctions connected thereto and legs, according to exemplary embodiments of the disclosed subject matter. Main pole 400 is covered by removable junction 425, 410, 442, 444, 446, 448 and 450 almost to the fullest, from one locking unit 430 to the other. removable junctions 425 and 450 are attached to legs 420 and 455, respectively. In some cases, the legs may also carry candlestick holders. The candelabra apparatus may have two or more legs extending downwards from the removable junctions or from the main pole. The candelabra apparatus may have a base connected to the main pole, to raise the candelabra from the surface, such as a table. Removable junction 444 is not attached to any arm, and functions as a place holder, to maintain the other removable junctions in their position and prevent the other removable junctions from sliding on the external surface of the main pole 400. Removable junction 410 is connected to arm 412 that ends in candlestick holder 415. Removable junction 442 is connected to arm 452 that ends in candlestick holder 458. Removable junction 446 is connected to arm 460 that ends in candlestick holder 465. Removable junction surface 448 is connected to arm 480 that ends in candlestick holder 485. FIG. 4B provides a bottom view and FIG. 4C provides a top view.

Figure 5:
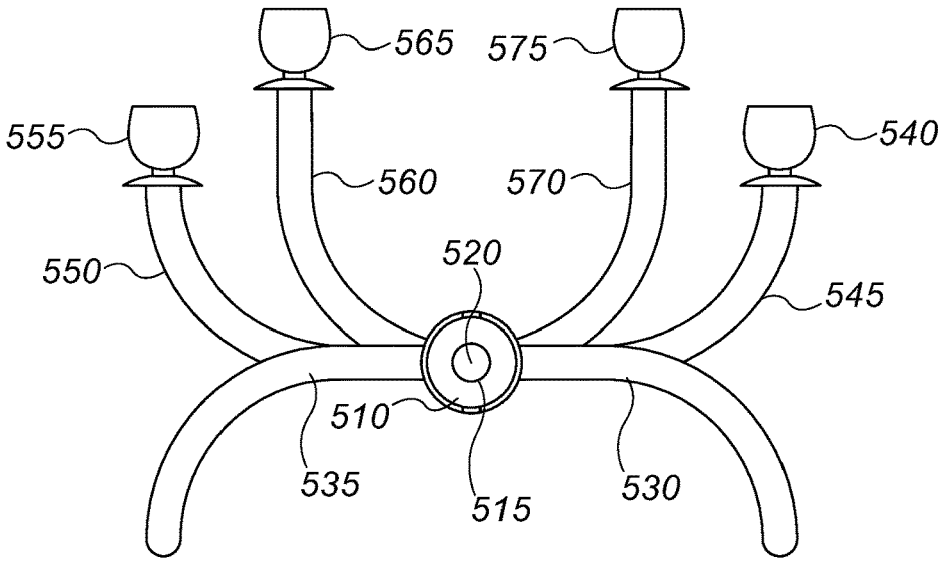
FIG. 5 shows a side view of an adjustable candelabra apparatus with multiple removable junctions connected thereto and legs, according to exemplary embodiments of the disclosed subject matter.

FIG. 5 shows a side view of an adjustable candelabra apparatus with multiple removable junctions connected thereto and legs, according to exemplary embodiments of the disclosed subject matter. The removable junction 510 surrounds the external surface 515 of the main pole. Locking unit 520 is positioned on one end of the main pole, for example by a user of the adjustable candelabra apparatus. The locking unit 520 may be removed to enable insertion or replacement of a removable junction into or from the apparatus. For example, when an owner of the adjustable candelabra apparatus wishes to remove a removable junction that is not connected to any candlestick holder and replace it with a removable junction connected to 4 candlestick holders. The user may replace a single removable junction with two or more removable junctions with smaller width, for example when wishing to add candlestick holders to the apparatus.

Several arms and legs extend from the main pole, such as legs 530, 535 and arms 545, 570, 560 and 550. Arm 545 ends with candlestick holder 540. Arm 570 ends with candlestick holder 575. Arm 560 ends with candlestick holder 565. Arm 550 ends with candlestick holder 555.

Figure 6:
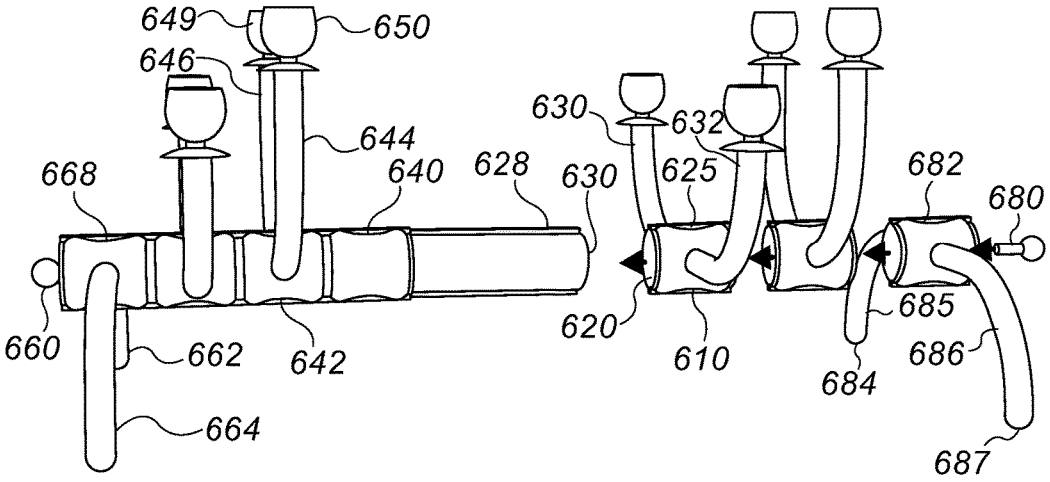
FIG. 6 shows an exploded view of an adjustable candelabra apparatus with multiple removable junctions connected thereto and legs, according to exemplary embodiments of the disclosed subject matter.

FIG. 6 shows an exploded view of an adjustable candelabra apparatus with multiple removable junctions connected thereto and legs, according to exemplary embodiments of the disclosed subject matter. The main pole 628 carries removable junctions 640, 642, 668 while removable junctions 625 and 682 are about to be added to the apparatus by sliding on the external surface 630 of the main pole 628. The external surface 630 will be in contact with internal surface 620 of removable junction 625 and additional removable junction, such as removable junction 682. A locking unit 660 prevents removable junction 668 from sliding out of the main pole 628, and another locking unit 680 will lock the added removable junction 625, and 682. For example by inserting a narrow section of the locking unit 680 into the removable junction with 682 or into a hollow section in the main pole 628. Removable junction 668 is attached to legs 662, 664. Removable junction 682 is attached to legs 685, 686. Legs 685, 686 end with tips 684, 687 respectively, which are in contact with the surface.

Some of the removable junctions may have a flat top or a polygon circumference containing flat surfaces, for example in case the users of the apparatus wish to place an object on the top of the main pole. For example, removable junction 610 has a flat top 625 and two arms 631, 635. Removable junction 640 is not connected to any arm. Removable junction 642 is connected to arms 644, 646 that end with candlestick holders 650, 648, respectively.

Figure 7:
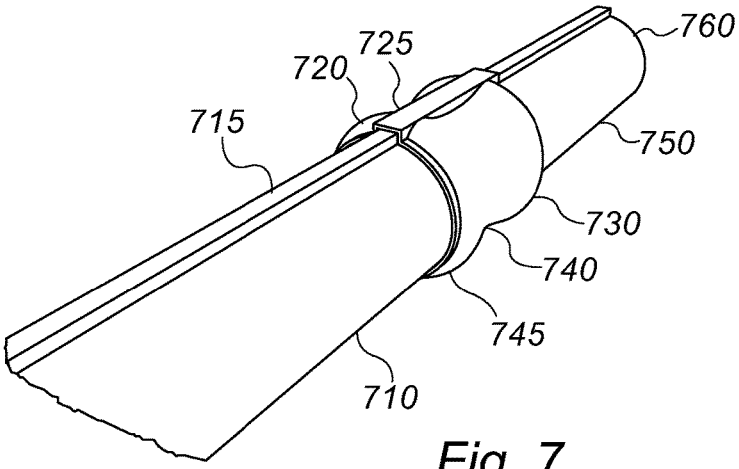
FIG. 7 shows an adjustable candelabra apparatus with multiple removable junction with a ring shaped internal interface connected thereto and legs, according to exemplary embodiments of the disclosed subject matter.

FIG. 7 shows an adjustable candelabra apparatus with multiple removable junction with a ring shaped internal interface connected thereto and legs, according to exemplary embodiments of the disclosed subject matter. Main pole 710 has a flat top 715 that prevents the removable junction with the ring shaped internal interface from rotating around the axis of the main pole 710. Similarly, the removable junction with a ring shaped internal interface 720 has a flat top 725 that fits the flat top 715 of the main pole 710. The removable junction with a ring shaped internal interface 720 may be inserted to the apparatus from one end 760 of the main pole 710 along section 750 of the main pole 720. The removable junction with a ring shaped internal interface itself may vary in width, for example have a narrower section 740 between two wider sections 730, 745, to enable a user to maneuver the removable junction with a ring shaped internal interface 720 easily.

Figure 8:
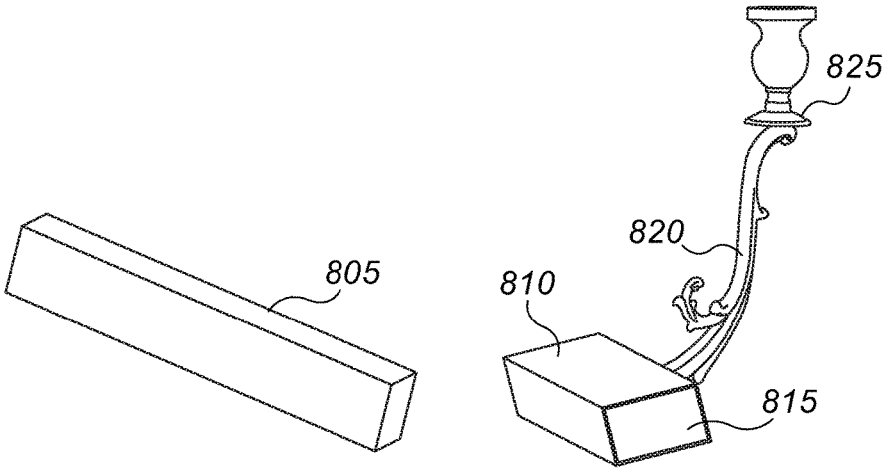
FIG. 8 shows an adjustable candelabra apparatus with a square shaped pole multiple junctions connected thereto, according to the exemplary embodiments of the disclosed subject.

FIG. 8 shows an adjustable candelabra apparatus with a square shaped pole having multiple junctions connected thereto, according to exemplary embodiments of the disclosed subject matter. FIG. 8 shows a square shaped pole 805 that can be used to hold multiple junctions with arms ending with candlesticks. Removable junction 810 comprises an arm 820 and a square shaped internal interface 815. Square shaped internal interface 815 is designed to be slid over the square shaped pole 805 and located fasten as discloses in FIG. 2. In some cases, where the main pole 805 is square shaped, the removable junction 810 cannot rotate or move in rounds. Arm 820 also comprises candlestick 825 with the same functionality as disclosed above. In some exemplary embodiments of the disclosed subject matter, the main pole 805 may be elliptic, triangular, in a shape of a star or any other shape, thus the internal interface shape of the removable junctions may be at the same shape as the main pole 805, so it can slip over the pole. In some cases, the square shaped internal interface 815 may comprise a lock or a screw to fasten removable junction 810.

Figure 9:
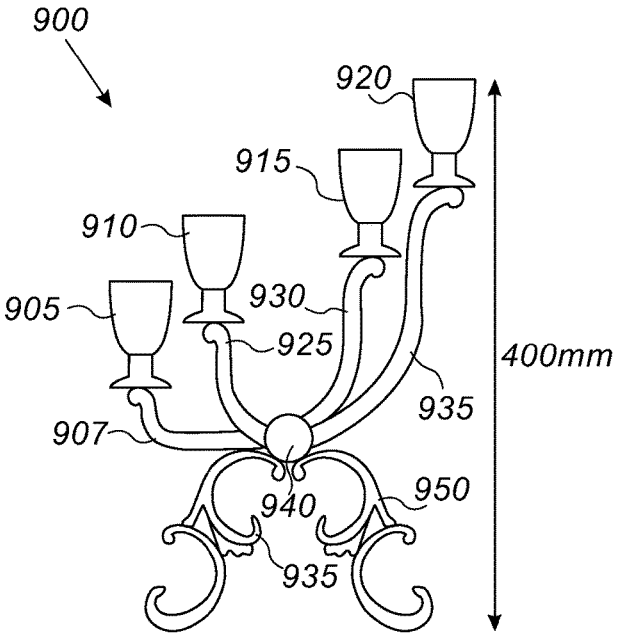
FIG. 9 shows a side view of a single removable junction with a ring shaped internal surface having 4 arms of an adjustable candelabra apparatus with optional measurements, according to exemplary embodiments of the disclosed subject matter.

FIG. 9 shows a side view of a single removable junction with a ring shaped internal surface having 4 arms of an adjustable candelabra apparatus with optional measurements, according to exemplary embodiments of the disclosed subject matter. Junction 900 with a ring shaped internal surface 940 comprises several arms extending outwards, such as arm 907 which ends with candlestick 905, arm 925 which ends with candlestick 910, arm 930 which ends with candlestick 915, and arm 935 which ends with candlestick 920. Junction with a ring shaped internal surface 940 also comprises a corrugated ornamental Arms 935 and 950 which extend down, beneath the horizontal plane of the removable junction. Junction 900 also comprises a ring shaped internal interface 940, which the pole of the candelabra can be threaded thereto.

Figure 10A:
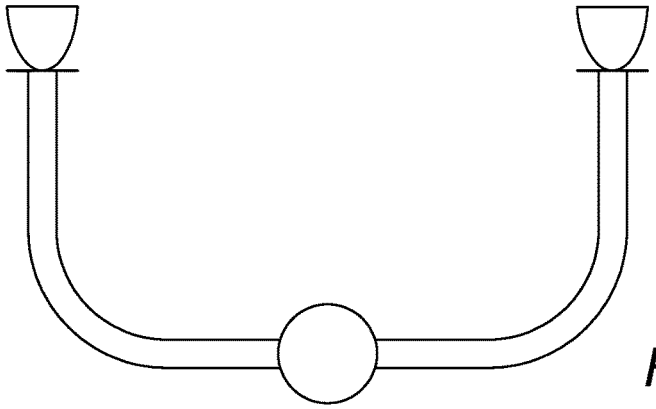
FIGS. 10A-10C show various embodiments of an adjustable candelabra apparatus with multiple removable junctions connected thereto, according to exemplary embodiments of the disclosed subject matter.
Figure 10B:
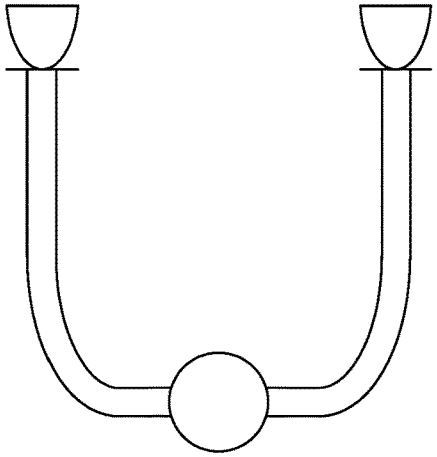
Figure 10C:
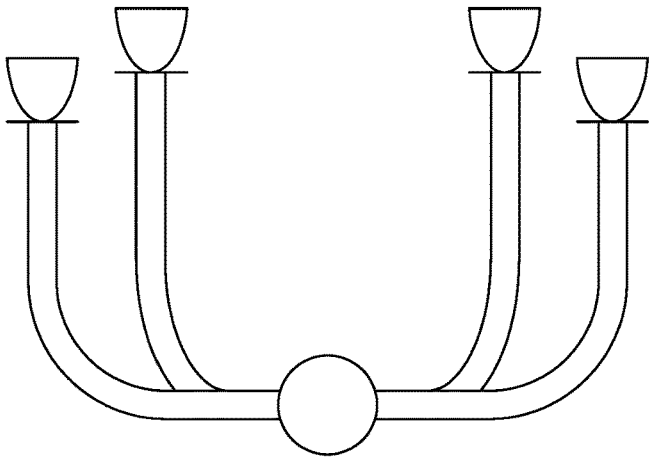

FIG. 10 shows various embodiments of an adjustable candelabra apparatus with multiple removable junctions connected thereto, according to exemplary embodiments of the disclosed subject matter. In the upper embodiment ("1"), the removable junction C is connected to two arms D, which are relatively wide and short, for example relative to the middle embodiment ("2"). The arms D ends with a holder A or a plate B located between the arm and the holder A. in the bottom embodiment ("1+2"), there are two removable junctions, each of the two removable junctions is connected to two arms. Thus, the front ring shaped interfaces of the removable junctions are adjacent to the lower arms and the rear ring shaped interface of the junctions are connected to the higher arms, in a narrower configuration.

Figure 11A:
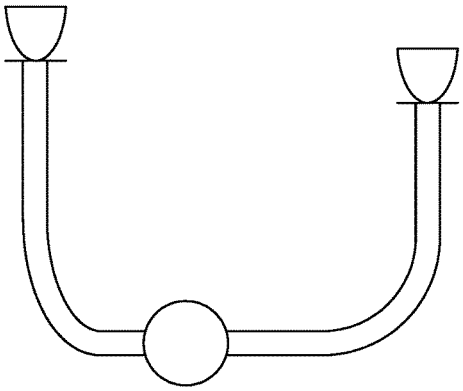
FIGS. 11A-11D show multiple arms arrangements of an adjustable candelabra apparatus, according to exemplary embodiments of the disclosed subject matter.
Figure 11B:
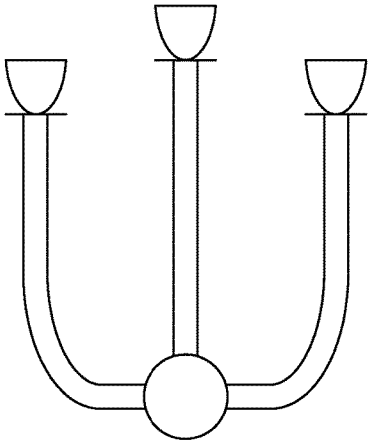

FIGS. 11A-11D show multiple arms arrangements of an adjustable candelabra apparatus, according to exemplary embodiments of the disclosed subject matter. FIG. 11A shows a removable junction connected to two arms, the right arm is relatively wide and short, while the left arm is relatively high and narrow. FIG. 11B shows a removable junction connected to three arms, a first arm at the right, a second arm at the left and a third arm extending upwards or at the direction of the main pole.

Figure 11C:
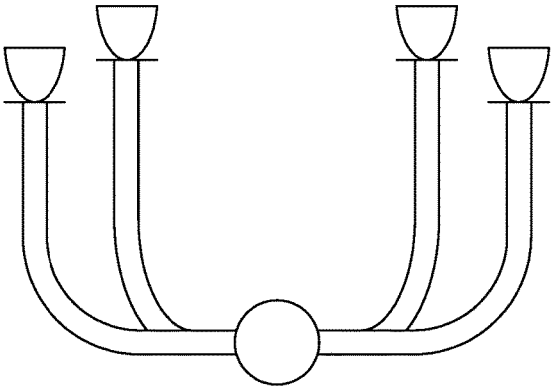
Figure 11D:
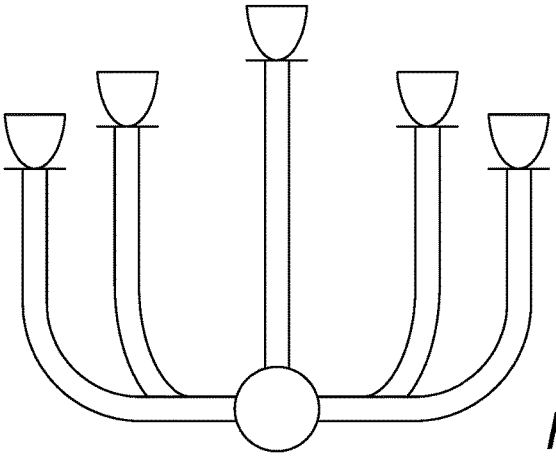

FIG. 11C shows a removable junction connected to four arms, or two subsequent removable junctions connected totally to four arms. Of the four arms, two may be relatively high and the other two are relatively low. Some removable junctions may extend more aside from the removable junction, also defined as being a wider arm, while other arms are extending less aside from the removable junction. FIG. 11D shows a removable junction connected to five arms, two arms to the right, from which one is higher and narrower and the other is lower and wider. The third arm extends upwards, and the other two arms extend to the left side, one wider and the other narrower.

Figure 12A:
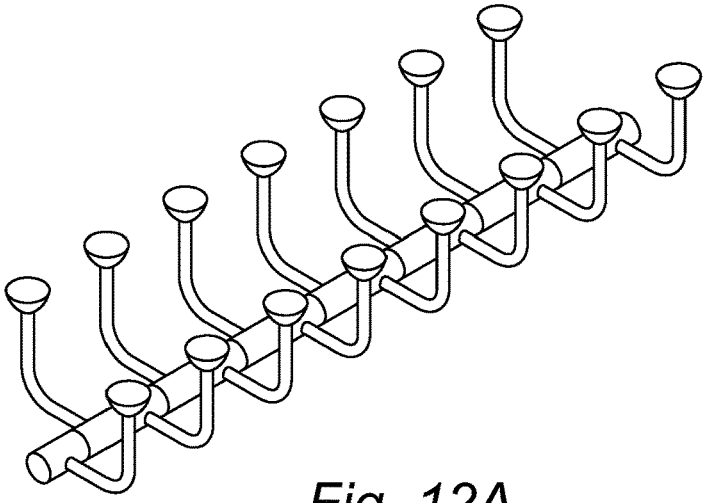
FIGS. 12A-12B show an adjustable candelabra apparatus, according to exemplary embodiments of the disclosed subject matter.
Figure 12B:
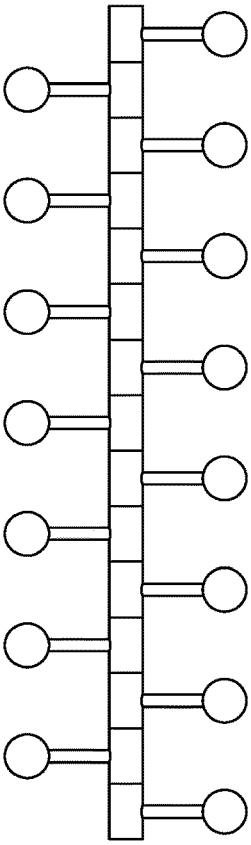

FIGS. 12A-12B show an adjustable candelabra apparatus, according to exemplary embodiments of the disclosed subject matter. FIG. 12A shows a candelabra comprises a main pole and 8 arms extending to both sides of the main pole to form a Jewish Menorah (Hanukkah). FIG. 12B shows an adjustable candelabra apparatus comprising removable junctions connected to arms, such that one side of the main pole comprises 8 arms and the other side comprises 7 arms, such that the adjustable candelabra apparatus can function also as a Jewish Menorah (Hanukkah) but also as a candelabra of 15 candles.

While the disclosure has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings without departing from the essential scope thereof. Therefore, it is intended that the disclosed subject matter not be limited to the particular embodiment disclosed as the best mode contemplated for carrying out this invention, but only by the claims that follow.

The invention claimed is:

1. An adjustable candelabra apparatus comprising:

an elongated main pole;

plurality of removable junctions comprising internal interface sliding on a surface of the main pole, said plurality of removable junctions is configured to be slid onto the main pole from one end of the elongated main pole;

at least one locking unit attached to one end of the elongated main pole, configured to prevent the plurality of removable junctions from sliding off the main pole;

arms extending from the plurality of removable junctions, said arms comprising candlesticks holders, wherein said elongated main pole is covered by said removable junctions almost to the fullest, and wherein said at least one locking unit is configured to fasten all removable junctions on the main pole.

2. The adjustable candelabra of claim 1, further comprising legs extending from said removable junctions, said legs connect the candelabra on a surface.

3. The adjustable candelabra of claim 1, further comprising legs extending from said elongated main pole, said legs connect the candelabra on a surface.

4. The adjustable candelabra of claim 1, wherein the main pole is extendable.

5. The adjustable candelabra of claim 1, wherein the main pole is assembled of two or more sections connected in series.

6. The adjustable candelabra of claim 1, wherein a cross section of said main pole is of elliptical shape.

7. The adjustable candelabra of claim 1, wherein a cross section of said main pole is of a polygonal shape.

8. The adjustable candelabra of claim 1, wherein said removable junctions comprise internal interfaces designed to be slid on said main pole.

9. The adjustable candelabra of claim 8, wherein said internal interface is ring shaped.

10. The adjustable candelabra of claim 8, wherein said internal interface is in a shape of a polygon.

11. The adjustable candelabra of claim 8, wherein said internal interface is in a shape of an ellipse.

12. The adjustable candelabra of claim 1, wherein said internal interface is in a shape of a cone.

13. The adjustable candelabra of claim 1, wherein said arms are connected to said removable junctions with a screw.

14. The adjustable candelabra of claim 1, wherein the removable junctions surround the entire cross section of the elongated main pole.

15. The adjustable candelabra of claim 1, wherein the removable junctions surround a portion of the cross section of the elongated main pole.

16. The adjustable candelabra of claim 1, wherein a cross section of the elongated main pole is circular with a flat top, and wherein the internal interface of the removable junctions is circular with a flat top that fits the flat top of the elongated main pole.

17. The adjustable candelabra of claim 1, further comprises legs extending from said removable junctions or from the elongated main pole, said legs connect the candelabra on a surface; a locking unit configured to fasten all removable junctions on the main pole.

18. The adjustable candelabra of claim 1, wherein the elongated main pole is squared/rectangular shaped.

19. The adjustable candelabra of claim 18, wherein said removable junctions comprises a square shaped internal interface.

* * * * *